US008707911B2

(12) United States Patent
Saviharju et al.

(10) Patent No.: US 8,707,911 B2
(45) Date of Patent: Apr. 29, 2014

(54) COOLING SYSTEM FOR PORTS IN A BOILER

(75) Inventors: Kari Saviharju, Espoo (FI); Jorma Simonen, Marietta, GA (US); Lasse Koivisto, Varkaus (FI); Markku Tanttu, Hirvensalmi (FI)

(73) Assignee: Andritz Oy, Helsinki (FI)

( * ) Notice: Subject to any disclaimer, the term of this patent is extended or adjusted under 35 U.S.C. 154(b) by 1195 days.

(21) Appl. No.: 11/718,157

(22) PCT Filed: Oct. 26, 2005

(86) PCT No.: PCT/FI2005/000460

§ 371 (c)(1),
(2), (4) Date: Jul. 8, 2009

(87) PCT Pub. No.: WO2006/045884

PCT Pub. Date: May 4, 2006

(65) Prior Publication Data

US 2009/0272339 A1 Nov. 5, 2009

Related U.S. Application Data

(60) Provisional application No. 60/622,013, filed on Oct. 27, 2004.

(51) Int. Cl.
*F23D 14/78* (2006.01)

(52) U.S. Cl.
USPC ..... 122/6.5; 110/182.5

(58) Field of Classification Search
USPC ..... 122/6.5; 110/182.5
See application file for complete search history.

(56) References Cited

U.S. PATENT DOCUMENTS

| | | | | | |
|---|---|---|---|---|---|
| 138,184 | A | * | 4/1873 | Pearse | 266/236 |
| 725,747 | A | * | 4/1903 | Moore | 202/243 |
| 782,298 | A | * | 2/1905 | Thos | 165/146 |
| 1,936,161 | A | * | 11/1933 | Hedrich | 122/4 R |
| 3,233,597 | A | | 2/1966 | Svendsen | |
| 3,742,916 | A | * | 7/1973 | Wessberg et al. | 122/390 |
| 4,750,649 | A | * | 6/1988 | Fahey et al. | 222/592 |
| 5,528,999 | A | * | 6/1996 | Salmi | 110/182.5 |
| 5,667,201 | A | * | 9/1997 | Beveridge et al. | 266/196 |
| 6,024,028 | A | * | 2/2000 | Simonen | 110/182.5 |
| 6,055,943 | A | * | 5/2000 | Cochrane et al. | 122/6.5 |

(Continued)

FOREIGN PATENT DOCUMENTS

| | | |
|---|---|---|
| EP | 0 686 807 | 12/1995 |
| JP | 51-103102 | 8/1976 |

(Continued)

OTHER PUBLICATIONS

International Search Report mailed Feb. 21, 2006.

*Primary Examiner* — Kang Hu
*Assistant Examiner* — John Bargero
(74) *Attorney, Agent, or Firm* — Nixon & Vanderhye P.C.

(57) ABSTRACT

A cooling system for air ports and other ports in furnace walls includes a cooling medium pumping system and ports provided with a cooling medium piping or channels inside the metallic port material. The liquid flow generated by the cooling medium system cools the ports. The ports are constructed of a casting material, and the ports are provided with a cooling liquid flow, which passes in a piping or pipings or channels inside the casting material of the ports.

29 Claims, 5 Drawing Sheets

(56) References Cited

U.S. PATENT DOCUMENTS

| | | | | |
|---|---|---|---|---|
| 6,382,929 | B1 * | 5/2002 | Di Benedetto | 417/307 |
| 6,415,724 | B1 * | 7/2002 | Albrecht et al. | 110/180 |
| 6,925,969 | B1 * | 8/2005 | Brown et al. | 122/379 |
| 7,510,679 | B2 * | 3/2009 | Motomura et al. | 266/241 |

FOREIGN PATENT DOCUMENTS

| | | |
|---|---|---|
| JP | 06-066412 | 3/1994 |
| JP | 10-153312 | 6/1998 |
| WO | WO 03/067153 | 8/2003 |

* cited by examiner

COOLING SYSTEM FOR PORTS IN A BOILER

CROSS RELATED APPLICATION

This application is the US national phase of international application PCT/FI2005/000460 filed 26 Oct. 2005 which designated the U.S. and claims benefit of U.S. provisional application No. 60/622,013 filed 27 Oct. 2004, the entire contents of these applications are incorporated by reference.

The present invention relates to a cooling system for ports in a wall of a boiler. A typical port is an air port for feeding air to a boiler furnace. In addition to air ports, there are a number of openings, apertures, holes or passages in boiler walls for feeding substances, such as fuel or gas or chemicals, or for different instruments, devices, or equipment, such as control devices. These structures are called ports in connection with this invention. In particular, the invention relates to air ports and other ports of a black liquor recovery boiler.

Black liquor produced in pulp manufacture is combusted in a recovery boiler, which is an essential apparatus in the chemical recovery circulation of a sulfate and other Na-based pulp manufacturing processes. The cooking chemicals from a digester are turned into a form suitable for the recovery process. In a sulfate process the most important chemicals are sodium and sulfur. Organic substances dissolved in black liquor during digestion are combusted in the boiler producing heat which is used, on one hand, in converting the inorganic compounds contained in the waste liquor back into chemicals to be used in the digestion and, on the other hand, in the production of steam. The inorganic matter of the waste liquor melts in the high temperature of the boiler and runs down as smelt to the bottom of the furnace.

The smelt is taken from the bottom of the boiler along cooled smelt spouts to a tank in which it is dissolved into water or weak white liquor to produce soda lye, i.e. green liquor. The main components of the smelt and thus also of the green liquor in a sulfate process are sodium sulfide and sodium carbonate. The green liquor is then transported to a causticizing plant for white liquor production.

The air required for the combustion of the organic material in the black liquor is led to the furnace of the recovery boiler from air distribution channels arranged at various levels around the furnace, through the air ports in the walls of the furnace. A port opening is created by bending waterwall tubes outwardly and away from each other. The air is most commonly introduced into the furnace at three levels. Lowest, there is a primary air level, above that a secondary air level, and highest, above the liquor nozzles, a tertiary air level. There may as well be more than three air levels in the boiler.

Typically nozzles are disposed in the air port openings in the boiler wall so as to direct air into the furnace. Nozzles have typically been manufactured of different metal plate materials by welding. The nozzles are attached onto the tube panel walls of the furnace e.g. by welding or in some other mechanical way. Air ports may also be constructed of a cast material seal-welded to the wall tubes forming the opening.

Combustion air is led in the air ports from air ducts surrounding the boiler. The air ports and the structures in the vicinity thereof are cooled by the flowing combustion air, and by conduction to the furnace walls. Combustion air temperature is typically 20-200° C., depending on which combustion air is considered. Normally the lowest air flow, which is called primary air, has the highest temperature, and the air flows, which locate highest in the furnace have the lowest temperature. The air feeds (e.g. tertiary) above the black liquor feed level or levels (above the liquor guns) are often without preheating. When the cooling takes place via the air flow through the air port, the cooling effect is clearly less effective than it would be with water, either with boiling or with unboiling water. This is due to the thermodynamic and heat transfer properties of the two media (air vs. water). Also cooling via conduction from the air port to the furnace wall tubes, which are cooled by boiling boiler water, is much less effective than it would, if water would be in direct contact with the port. This is because the distance from the cooled inner surface of a water tube to the tip of the uncooled front face of the air port is long, and the heat transfer efficiency between the cast air port and the cooling furnace wall tube is not very effective. To make the cooling effect via the furnace wall tubes more effective, sleeve-type airports have been used. In this construction the airport has been made of plate material, which is bended into the right shape and welded into the furnace wall tubes. The potential drawback of this design is related to such boiler design and operation, which causes splashing of smelt or black liquor into the port. The main components of the smelt in a sulfate pulping process are sodium carbonate and sodium sulphide. The smelt splashes on the outer side of the air port cause rapid heating of the structure of the air port up to the melting point of the smelt, whereby the salts cause corrosion and erosion in the air ports. Rapid changes in the temperature generate thermal weariness and stress corrosion cracking in the structures of the air port and even in the encircling tubes of the furnace. Especially harmful are the varying temperature differences between the wall tubes and the air port sleeve material, especially their fastening welds.

The problems, which are described above for air ports, are valid also for other ports and for finned areas of the furnace, where the width of the uncooled area is too wide. These uncooled areas are related to various ports, openings, apertures or lance-type connections in the walls of a boiler furnace. In addition to air ports, there are a number of openings, apertures, holes in furnace walls for feeding substances, such as fuel or gas, or for different devices, such as control devices. These structures are called ports in connection with this invention, and effective cooling is typically needed in these ports. The critical width for the uncooled area in the lower furnace of a recovery boiler is typically 15-25 mm. Also in these cases the design can be improved by introducing specific cooling.

BRIEF DESCRIPTION OF THE INVENTION

The present invention is intended to ensure that the temperature of air ports or other ports and the structures of the wall of the furnace in the vicinity will not rise too high in view of corrosion, temperature changes, cracking and tightness. This results in remarkable decreases in repair and shutdown expenses. Especially the primary air ports closest to the smelt bed are exposed to detrimental effects of the smelt. In addition, the invention is to provide an apparatus easy to maintain and repair. In this way, it is possible to decrease repair and shutdown costs significantly. Further, the arrangement according to the invention decreases thermal stresses directed on the tube walls of the furnace.

The present invention, which eliminates (or at least reduces) the cooling problem of the air port and other ports of boilers, introduces effective cooling into the ports. The present invention allows the use of more efficient cooling media than air.

The cooling system for air ports and other ports in furnace walls according to the present invention comprises a cooling medium (liquid) pumping system and ports provided with (preferably in connection with the casting process) cooling medium piping or channels inside the metallic material. The liquid flow generated by the cooling medium system cools the ports so that the temperature of the air ports and other ports is maintained low enough for extending the useful life of the ports and structures in the vicinity thereof. The ports are constructed of a casting material and provided with a cooling liquid flow, which passes in a piping or pipings or channels inside the casting material of the ports. The cooling medium is a liquid, preferably water. The working pressure of the water can vary from a pressure lower than atmospheric pressure to a pressure slightly higher than atmospheric pressure.

The whole cooling system comprises liquid tanks, cooling liquid pumps, heat exchangers, control devices, electors, which are typically used in cooling medium circulation systems. Combustion boilers can have a cooling medium circulation system, to which the cooling system for air ports or other ports according to the invention can preferably be connected. Recovery boilers have smelt spouts for discharging smelt from the bottom of the furnace. The spouts are typically constructed of a double wall trough, with a continuous flow of cooling water passing between the inner and outer walls. The cooling medium flow used for cooling air pods or other ports can be wholly or partly connected to the smelt spout cooling system. Heat recovered in the cooling water can be used for warm water production, heating the boiler plant or for any other suitable purposes.

According to an aspect of the invention the cooling liquid piping is in metallic connection with the casting material, whereby an efficient heat transfer from the port to the cooling liquid is obtained. The cooling liquid flow is leak-safe in the port zone, because the cooling liquid piping is inside the casting material. The material of the ports and the material of the cooling liquid piping may be chosen appropriately based on the operating conditions. The flow amount and temperature of the cooling liquid may be chosen based on the corrosiveness of the conditions, the material and the construction of the port. The cast is preferably made of metal. A combination of metal and ceramic may be made to make the cast more heat- and corrosion-resistant.

The port construction consists of a casting port and a collar part, which is weldable to the wall tubes. The collar may be made by casting or some other method, e.g. made of round bar. The weldable collar part may in some applications be omitted, whereby a longer lip of the cast port compensates its role.

The piping or channels in the cast port can be arranged so that the cooling medium is introduced into the cast through one inlet tube. The inlet tube has a junction, or junctions where it is divided into two or more tubes, which continue separately around the opening of the port. The tubes can be connected together just after the travel around the opening, so that the heated medium is led away through one outlet tube.

The cast port can also have two or more inlet tubes for the cooling medium, which tubes continue separately through the cast port so that the cooling medium is led through several outlet tubes from the cast port. The tubes, which go through the cast port, are totally inside the casting material, but some parts thereof may be outside the casting material. Heat transfer between the cooling medium and port is, of course, the more efficient the more the tubes are inside the port.

The flow of the cooling medium through the cast can be arranged by means of channels made into the cast during the casting stage. The channel or channels go around the opening of the port. The cooling medium can be fed into the channels through one or more inlet tubes, and the cooling medium is led from the cast through one or more outlet tubes. The cast is provided with one or more inlet tubes for introducing the cooling medium into the cast and with one or more outlet tubes.

The cooling arrangement may be used for primary, secondary, tertiary, and for upper air ports in recovery boilers. In these cases air is introduced into the furnace via the opening of the port. The cooling arrangement may be used for liquor gun ports in recovery boilers. In these cases the liquor gun is located in the opening of the port, or liquor is sprayed through the opening of the port into the furnace.

The cooling arrangement may be used for start-up, load and malodorous gas (non-condensable gas) burners in recovery boilers. In these cases the burner is located in the opening of the port. The port can be a part of the burner. Moreover, the cooling arrangement may be used for smelt bed camera ports, for instrument ports and for inspection and observation ports in recovery boilers. The cooling arrangement may also be used for entrance doors in recovery boilers.

The cooling arrangement may be used for sootblower openings in recovery boilers, and for smelt spout openings and for smelt openings in recovery boilers. The port is part of the smelt spout or the spout is part of the port. The cooling arrangement may also be used for $NO_x$ reduction agent injection ports in recovery boilers. The cooling arrangement is applicable especially in recovery boilers used for burning black liquor generated in the production of cellulose, but it may naturally be applied in other corresponding combustion devices as well.

BRIEF DESCRIPTION OF THE DRAWINGS

At least one embodiment of the invention is described in more detail with reference to the appended Figures, of which.

DETAILED DESCRIPTION OF THE INVENTION

Figure 1:
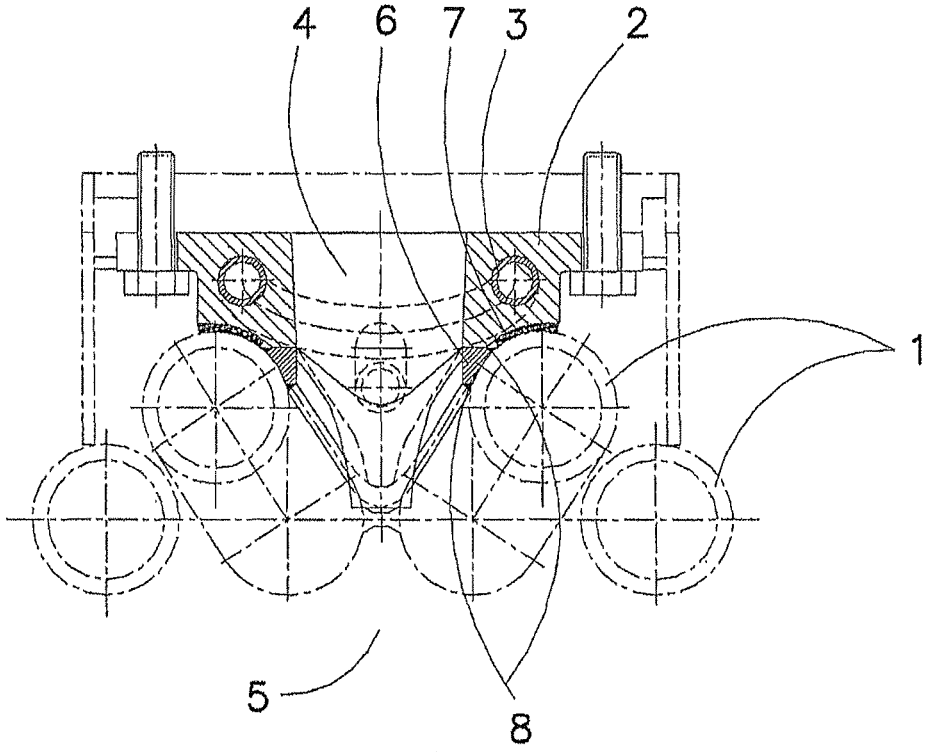
FIG. 1 illustrates an air port in a cutaway at a middle height of the port.
Figure 2:
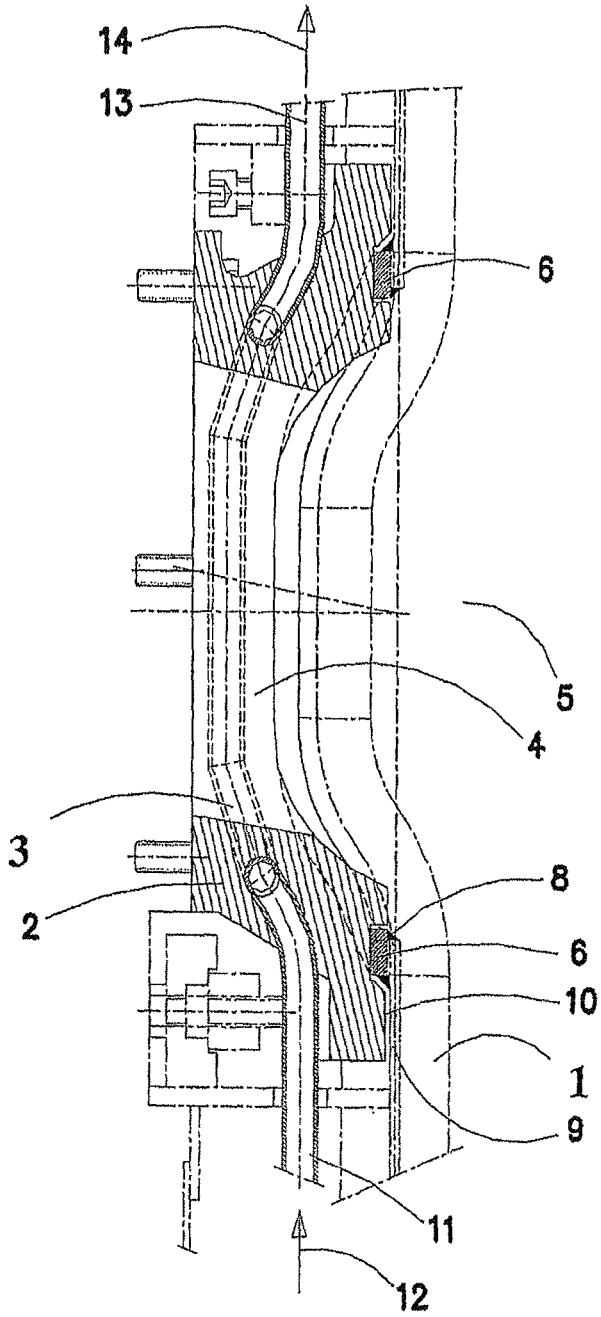
FIG. 2 illustrates an air port in a cutaway along a lateral direction of the port.

FIGS. 1 AND 2 illustrate an air port structure according to the invention. Combustion air flows into a furnace 5 of a boiler through an air port 4. The air port opening is formed by bending adjacent water wall tubes 1 apart so that the port assumes an elongated shape. The air port 4 is defined by a nozzle-like structure 2 which is disposed in the furnace wall and produced by casting.

Prior to casting, the cast is provided with a tube ring 3 or two separate tubes. In the casting stage, the appropriate fitting of the tube ring assembly 3 inside the casting material has to be ensured. A collar 6 is fitted by welding in the opening formed of wall tubes 1. The collar 6 may be made by casting or some other method, e.g. made of round bar. The facing surfaces of the air nozzle 2 and collar 6 are compatible for ensuring a sufficient tightness.

Insulating material 7 may be used between the air nozzle 2 and wall tubes 1. The collar 6 is welded (at 8) at the sides onto the wall tubes 1 and both at the top and at the bottom onto a fin 9. Sealing material 10 may be used at the top and at the bottom between the nozzle 2 and the fin 9. The air nozzle 2 is attached mechanically in some known way so that the facing surfaces of the nozzle 2 and collar 6 are in tight contact.

Cooling liquid 12 passes from a cooling liquid feed pipe 11 into the tube ring 3 as the flow is divided into branching ducts of the ring 3. The return flow 14 of the cooling liquid comes from a return pipe 13.

Figure 3A:
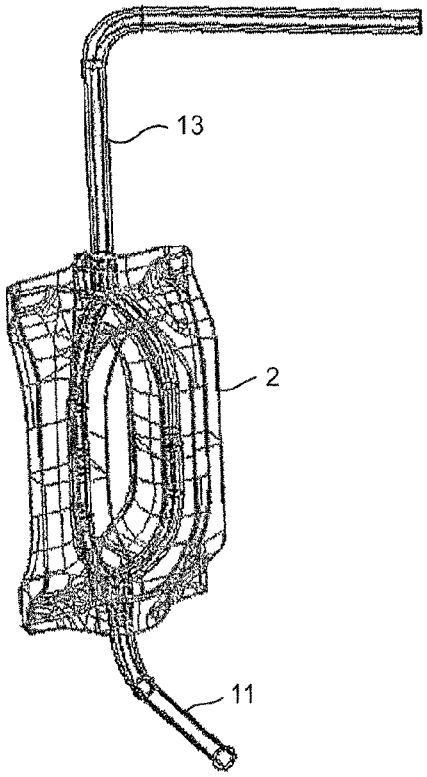
FIG. 3A is a wire-frame illustration and FIG. 3B is a solids illustration of a perspective view of a cast port construction.
Figure 3B:
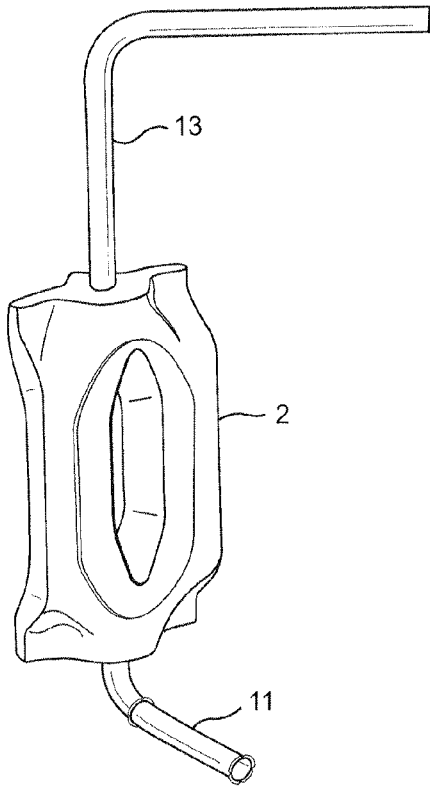

FIG. 3A and FIG. 3B show a whole cast port 2. Cooling medium is introduced through a pipe 11. Cooling pipes or tubes 3 go separately around the opening of the cast port. The heated cooling medium is discharged through a pipe 13 It is also possible that the cooling medium tubes are not located inside the nozzle-like port, but there is another cast piece, which is provided with a cooling system and which is in a close contact with the nozzle part. Especially the lower part of the nozzle is cooled by the other cast part.

Figure 4:
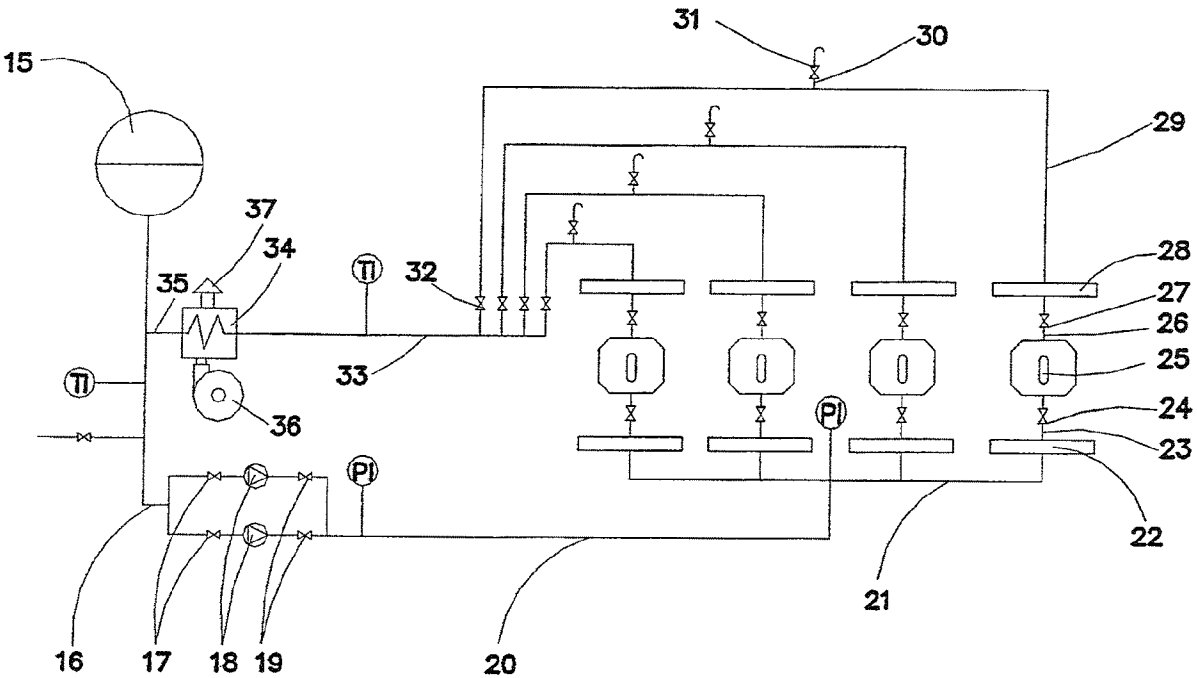
FIG. 4 illustrates a cooling system having a single air level.

FIG. 4 illustrates a cooling medium circulation for one air level in the system according to the invention (a one "air level" system). The cooling liquid equipment comprises a cooling liquid tank 15, piping 16, valves 17, pumps 18, valves 19, a pipe 20, a pipe 21, a manifold 22, a nozzle-specific feed pipe 23, a valve 24 in the feed pipe, a nozzle construction with its tube ring 25, a return pipe 26, a valve 27 for the return pipe, a collector tube 28, a tube 29, an air discharge tube 30, a valve 31 for the air discharge tube, a return line valve 31, a return tube 33, a heat exchanger 34, which may be of liquid/air or liquid/liquid type, a return tube 35 from the heat exchanger.

In case of a liquid/air heat exchanger, an air fan 36 cools the cooling liquid and heated air 37 may be led into the boiler room or into the atmosphere.

A pressurized flow for the cooling liquid is generated by means of pumps 18. The cooling liquid flows via piping into wall-specific manifolds 22. From the manifold 22, a cooling liquid feed tube 23 leads to each air nozzle 25. The flow of the liquid may be adjusted for each nozzle by means of valve 24, which may be either manually or automatically operated. The liquid flow cools the air nozzle and the return flow is directed via return tube 26 to the return line. The return flows of the cooling liquids for the nozzles are collected together with a wall-specific collector tube 28 and return tube 29. Via a common return tube 33 the cooling liquid flow is led into a heat exchanger 34, wherein heat energy is transferred to air or liquid, depending on the application.

The cooling liquid circulation may be provided with necessary devices for measuring the pressure and temperature. FIG. 4 shows the positioning of the measuring devices, mainly in view of manual control. If automatic regulation devices for flow amount control are used, the number of measuring devices is bigger.

Figure 5:
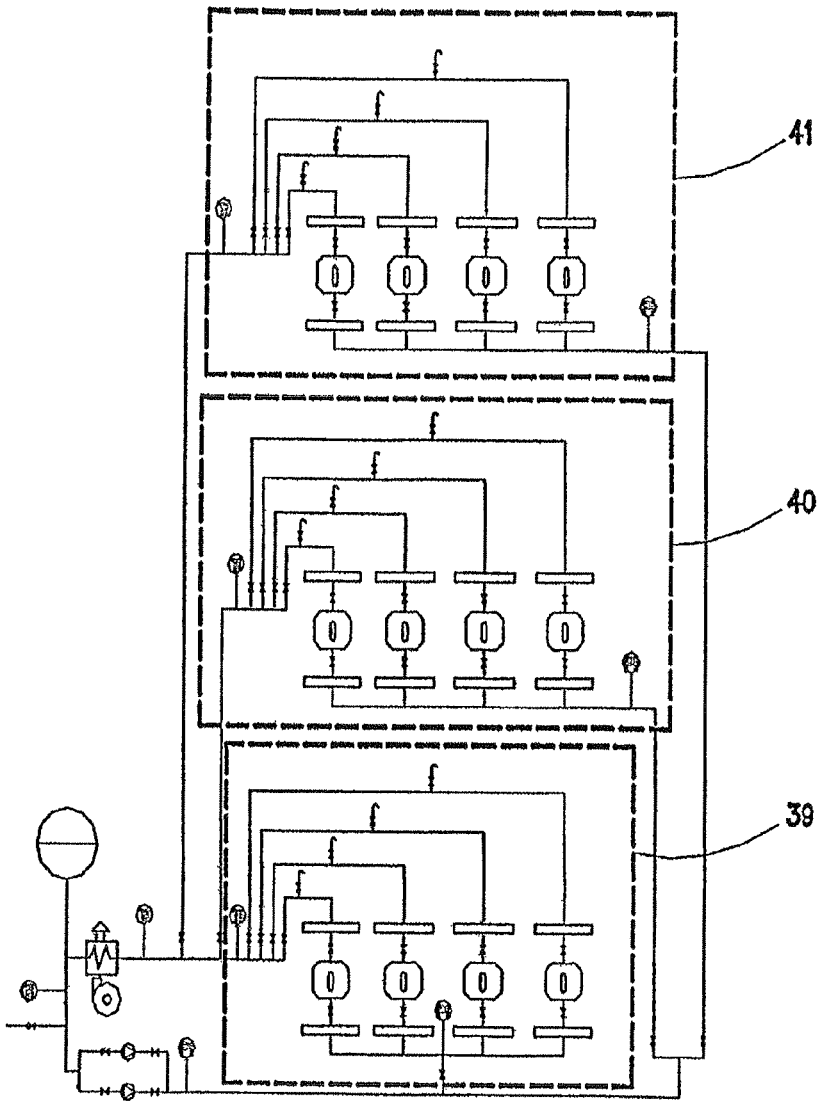
FIG. 5 illustrates a cooling system having three air levels.

FIG. 5 illustrates a cooling medium circulation for three air levels in the system according to another embodiment of the invention (a three "air level" system). The three air-level system has three air levels 39, 40 and 41 liquid-cooling system in parallel connection. The air levels may be primary, secondary and tertiary air levels. The main principle of the liquid-cooling system is the same as that of the one "air level" system of FIG. 4. The functioning of the system as a whole is ensured by choice of flow amounts and components.

Heat recovered in the cooling medium according to the invention can be used to generate warm water, hot water, steam, or to heat up other heat transfer media. Said warm water, hot water, steam or other heat transfer media can preferably be used:

for condensate preheating, make-up water preheating, feedwater preheating, combustion air preheating, heating a boiler house, in an evaporation plant for water evaporation from waste liquor, from biosludge, or from a mixture of both materials;

for drying of bark, wood waste and other biomasses;

for heating or for district heating;

in the cooking plant of a pulp mill;

in the bleach plant of a pulp mill;

for pretreatment of chips in a pulp mill;

for drying of pulp in a pulp mill.

Numerous alterations and modifications of the port arrangement herein disclosed will suggest themselves to those skilled in the art. For example, the port can be fitted to the wall tubes in another way than disclosed in connection with the Figures, and the invention is not limited to a certain way to fit or mount the port structure to the wall tubes of the boiler. All such modifications, which do not depart from the spirit of the invention, are intended to be included within the scope of the claims.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A port disposed in wall tubes of a recovery boiler and used for supplying a material flow to the recovery boiler or for positioning a device or equipment, wherein the port comprises: a cast material port configured to be fitted between adjacent wall tubes of the recovery boiler and including an opening through the wall tubes, and a cooling system integral to the cast material port, wherein the cooling system includes a cast flow passage in the cast material port and for a cooling medium that includes a liquid wherein the cast flow passage includes an inlet configured to receive the cooling medium entering the cast flow passage, an outlet configured to discharge the cooling medium from the flow passage and wherein between the inlet and outlet, the cast flow passage includes at least two, tubes or channels each adjacent one of opposite sides of the opening and the flow passage extends around the opening.

2. A port according to claim 1, wherein the cooling medium is water.

3. A port according to claim 2, wherein a working pressure of the cooling medium is lower than atmospheric pressure.

4. A port according to claim 1, wherein the cooling system is connected to another cooling system of the recovery boiler.

5. A port according to claim 4, wherein the cast port is an air port of a black liquor recovery boiler, and the another cooling system includes a smelt spout cooling system.

6. A port according to claim 1, wherein the cast port is attached to a collar weldable to the wall tubes of the recovery boiler.

7. A port according to claim 1, wherein the inlet is a single inlet and the outlet is a plurality of outlets, wherein the cooling medium is introduced into the cast port through the one inlet and discharged through the plurality of outlets.

8. A port according to claim 7, wherein the inlet includes at least one a junction, wherein the junction divides the cooling medium to flow into the at least two tubes or channels.

9. A port according to claim 8, wherein the at least two tubes or channels extend through the cast port from an upper edge of the port to a lower edge of the port.

10. A port according to claim 1, wherein the segments of at least two tubes or channels merge below the opening.

11. A port according to claim 1, wherein the port is a liquor gun port in a recovery boiler.

12. A port according to claim 1, wherein the port is used for at least one of a start-up, load and malodorous gas burner in a recovery boiler.

13. A port according to claim 1, wherein the port is used for at least one of a smelt bed camera port, for instrument port and inspection and observation port in a recovery boiler.

14. A port according to claim 1, wherein in the port comprises an entrance door in a recovery boiler and the door when closed covers the opening.

15. A port according to claim 1, wherein the opening in the port comprises a soot blower opening in the recovery boiler.

16. A port according to claim 1, wherein the opening in port comprises a smelt spout opening in the recovery boiler.

17. A port according to claim 1, wherein the port includes a NOx reduction agent injection port in the recovery boiler.

18. A port according to claim 1, wherein the cooling liquid flow is adjustable.

19. A port according to claim 1, wherein the cooling medium is connected to a smelt spout cooling system in a recovery boiler.

20. A port adapted to be disposed between wall tubes of a recovery boiler and providing a passage to the recovery boiler, wherein the port comprises: a nozzle structure including an aperture establishing the passage to the recovery boiler, and a cast base in which the aperture is formed; the cast base and nozzle structure configured to fit between adjacent tubes of the wall tubes; a cooling fluid passage in the cast base, wherein the cooling fluid passage includes an inlet on one side of the cast base to receive the cooling fluid, an outlet to discharge the fluid from the cast base, and at least two tubes or channels in the cast base and between the inlet, wherein the tubes or channels are each adjacent one of the opposite sides of the opening, wherein the cooling fluid passage extends around the perimeter of the opening, and a coupling to attach the cast base to the wall tubes of the recovery boiler.

21. A port as in claim 20 wherein the wall tubes are arranged side-by-side, and in parallel.

22. A port as in claim 20 wherein the base has a generally rectangular geometry perimeter and the aperture is an elongated slot centrally located on the base.

23. A port as in claim 20 wherein the cooling fluid passage is internal to the base.

24. A port as in claim 20 wherein the cooling fluid passage includes a junction to direct cooling fluid from a cooling fluid inlet to the base to the passage segments.

25. A port as in claim 20 wherein the coupling includes a collar adapted to be sandwiched between the base and the pair of adjacent water tubes.

26. A port adapted to be disposed in a wall of a recovery boiler and providing a passage into the recovery boiler, wherein the port comprises: a nozzle structure including an aperture and a cast base in which the aperture is formed, wherein the passage into recovery boiler is formed by the aperture; the nozzle structure configured to fit between adjacent cooling tubes of the wall of the recovery boiler; a cast cooling fluid passage integral in the cast base, wherein the cooling fluid passage includes a cooling fluid inlet on a first side of the cast base, a cooling fluid outlet on an opposite side of the cast base, and cooling fluid passage extends between the inlet and outlet, wherein the passage splits into at least two passage segments which are each adjacent one of an opposite side of the aperture, and the cooling fluid passage extends around the aperture, and a coupling to attach the cast base to at least one water tube in the wall of the recovery boiler.

27. A port as in claim 26 wherein the base has a generally rectangular geometry perimeter and the aperture is an elongated slot centrally located on the base.

28. A port as in claim 26 wherein the cooling fluid passage includes a junction to direct cooling fluid from the cooling fluid inlet to the passage segments.

29. A port as in claim 26 wherein the coupling includes a collar adapted to be sandwiched between the base and the at least one water tube.

* * * * *